US010627102B1

(12) United States Patent
Ghalebi

(10) Patent No.: US 10,627,102 B1
(45) Date of Patent: Apr. 21, 2020

(54) SEALING LINEAR EDGE OF LIGHTING ENCLOSURE AGAINST WATER AND DUST

(71) Applicant: Xeleum Lighting, Boynton Beach, FL (US)

(72) Inventor: Mehrdad Ghalebi, Peekskill, NY (US)

(73) Assignee: Xeleum Lighting, Boynton Beach, FL (US)

( * ) Notice: Subject to any disclaimer, the term of this patent is extended or adjusted under 35 U.S.C. 154(b) by 0 days.

(21) Appl. No.: 16/030,094

(22) Filed: Jul. 9, 2018

Related U.S. Application Data

(60) Provisional application No. 62/612,415, filed on Dec. 30, 2017.

(51) Int. Cl.

| | |
|---|---|
| ***F21V 31/00*** | (2006.01) |
| ***F21V 3/02*** | (2006.01) |
| ***F21V 15/015*** | (2006.01) |
| ***F21K 9/275*** | (2016.01) |
| *F21Y 115/10* | (2016.01) |

(52) U.S. Cl.
CPC ..... *F21V 31/005* (2013.01); *F21K 9/275* (2016.08); *F21V 3/02* (2013.01); *F21V 15/015* (2013.01); *F21Y 2115/10* (2016.08)

(58) Field of Classification Search
CPC ..... F21V 31/005; F21V 15/015; F21K 9/275
See application file for complete search history.

(56) References Cited

U.S. PATENT DOCUMENTS

| | | | | |
|---|---|---|---|---|
| 4,827,386 | A * | 5/1989 | Mackiewicz | F21S 8/04 362/147 |
| 8,585,245 | B2 | 11/2013 | Black et al. | |
| 2005/0248948 | A1* | 11/2005 | McCarthy, III | F21V 3/02 362/362 |
| 2011/0273877 | A1 | 11/2011 | Reed et al. | |
| 2013/0170209 | A1* | 7/2013 | Lee | F21V 31/005 362/249.01 |
| 2017/0227209 | A1* | 8/2017 | Slabek | F21V 31/005 |

FOREIGN PATENT DOCUMENTS

| | | |
|---|---|---|
| CN | 205690112 U | 11/2016 |

* cited by examiner

*Primary Examiner* — Julie A Bannan
(74) *Attorney, Agent, or Firm* — Lowenstein Sandler LLP

(57) ABSTRACT

A lighting enclosure protected against water and dust is described. An example lighting enclosure comprises: a first elongated part comprising a longitudinal groove element; a second elongated part attached to the first elongated part, wherein the second elongated part comprises an outwardly bent longitudinal edge element engaged with the longitudinal groove element; a linear gasket inserted in a gap between the longitudinal groove element and the outwardly bent longitudinal edge element; and a compression strip inserted between a base of the outwardly bent longitudinal edge element and a longitudinal overhanging element of the first elongated part.

20 Claims, 7 Drawing Sheets

SEALING LINEAR EDGE OF LIGHTING ENCLOSURE AGAINST WATER AND DUST

REFERENCE TO RELATED APPLICATIONS

This application claims the benefit of U.S. Patent Application No. 62/612,415, filed Dec. 30, 2017, the entirety of which is incorporated herein by reference.

TECHNICAL FIELD

The present disclosure is generally related to lighting enclosures, and is specifically related to methods of sealing linear edges of lighting enclosures against water and dust.

BACKGROUND

Depending on their intended usage, electrical enclosures, e.g., lighting enclosures, may require various degrees of protection against intrusion of water and dust. The protection effectiveness may be reflected by a value of the IP ("International Protection Marking") rating, which is described by International Electrotechnical Commission (IEC) standard 60529. For example, IP65 rating indicates that the rated enclosure is "dust tight" and protected against water projected from a nozzle; IP66 rating indicates that the rated enclosure is "dust tight" and protected against heavy seas or powerful jets of water; IP67 rating indicates that the rated enclosure is "dust tight" and protected against immersion; and IP67 rating indicates that the rated enclosure is "dust tight" and protected against complete, continuous submersion in water.

BRIEF DESCRIPTION OF THE DRAWINGS

The present disclosure is illustrated by way of examples, and not by way of limitation, and may be more fully understood with references to the following detailed description when considered in connection with the figures, in which.

DETAILED DESCRIPTION

Described herein are lighting enclosures protected against water and dust and methods of sealing linear edges of lighting enclosures against water and dust. A "lighting enclosure" herein shall refer to an assembly comprising a housing, a light diffuser, and one or more mounting elements for installing light emitting devices. In various illustrative examples, each light emitting device may comprise one or more light emitting diodes (LEDs), one or more discharge lamps, one or more halogen lamps, etc.

Certain intended usages of a lighting enclosure, e.g., outdoor lighting, impose strict requirements on protecting the lighting enclosure against intrusion of water and dust. Generally, IP rating values of 65 and higher indicate "dust tight" protection and at least some degree of protection against water intrusion. As a lighting enclosure would typically include at least two parts to be joined together (such as a housing and a light diffuser), various common implementations involve inserting a gasket between the surfaces to be joined and using several screws along the surface edge and/or applying a sealant along the surface edge before joining the surfaces together. Disadvantages of the common approaches include the necessity to regulate the turning force applied to the screws in order to achieve a uniform pressure distribution along the surface edge, the necessity to held the joined parts together after applying the sealant for a certain period of time ranging from several minutes to several hours, decreasing degree of protection as the sealant ages, etc.

Devices and methods of the present disclosure alleviate the above-noted and other known deficiencies of various common solutions by providing a lighting enclosure in which the housing and diffuser parts are joined together by inserting a linear gasket in a longitudinal groove element of the housing, engaging an outwardly bent longitudinal edge element of the diffuser with the longitudinal groove element such that the linear gasket would occupy the gap between the groove element and the edge element, and then inserting a compression strip between the base of the longitudinal edge element and an overhanging element of the housing. Made of a rigid material, the compression strip, once inserted between the base of the longitudinal edge element and an overhanging element of the housing, would push the base of the edge element to further engage with the groove element, thus compressing the linear gasket by reducing the gap between the groove element and the edge element, as described in more detail herein below with references to FIGS. 1-6.

Various aspects of the above referenced methods and devices are described in detail herein below by way of examples, rather than by way of limitation.

Figure 1:
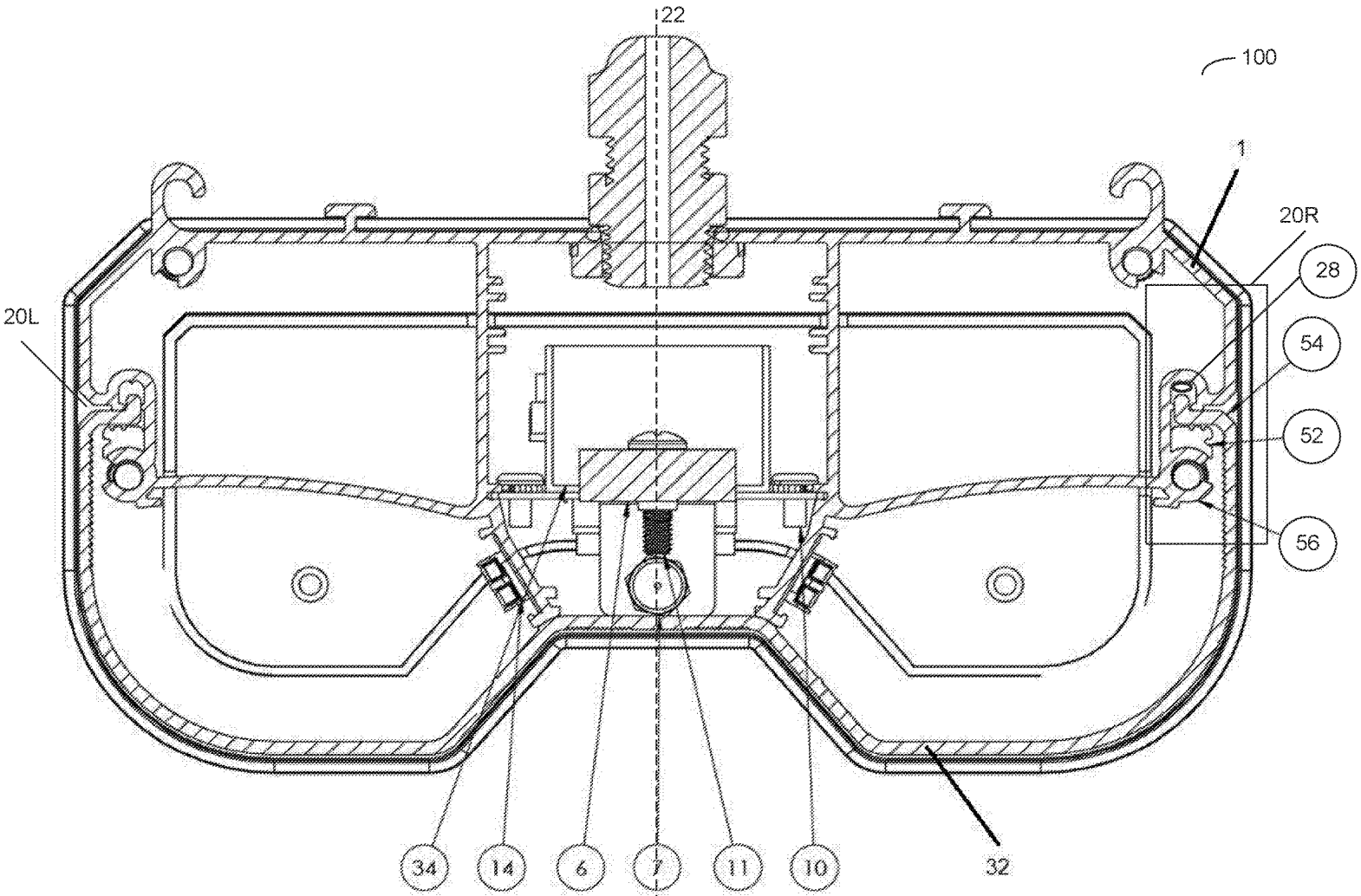
FIG. 1 schematically illustrates a transverse cross-section of an example lighting enclosure implemented in accordance with one or more aspects of the present disclosure.
Figure 2:
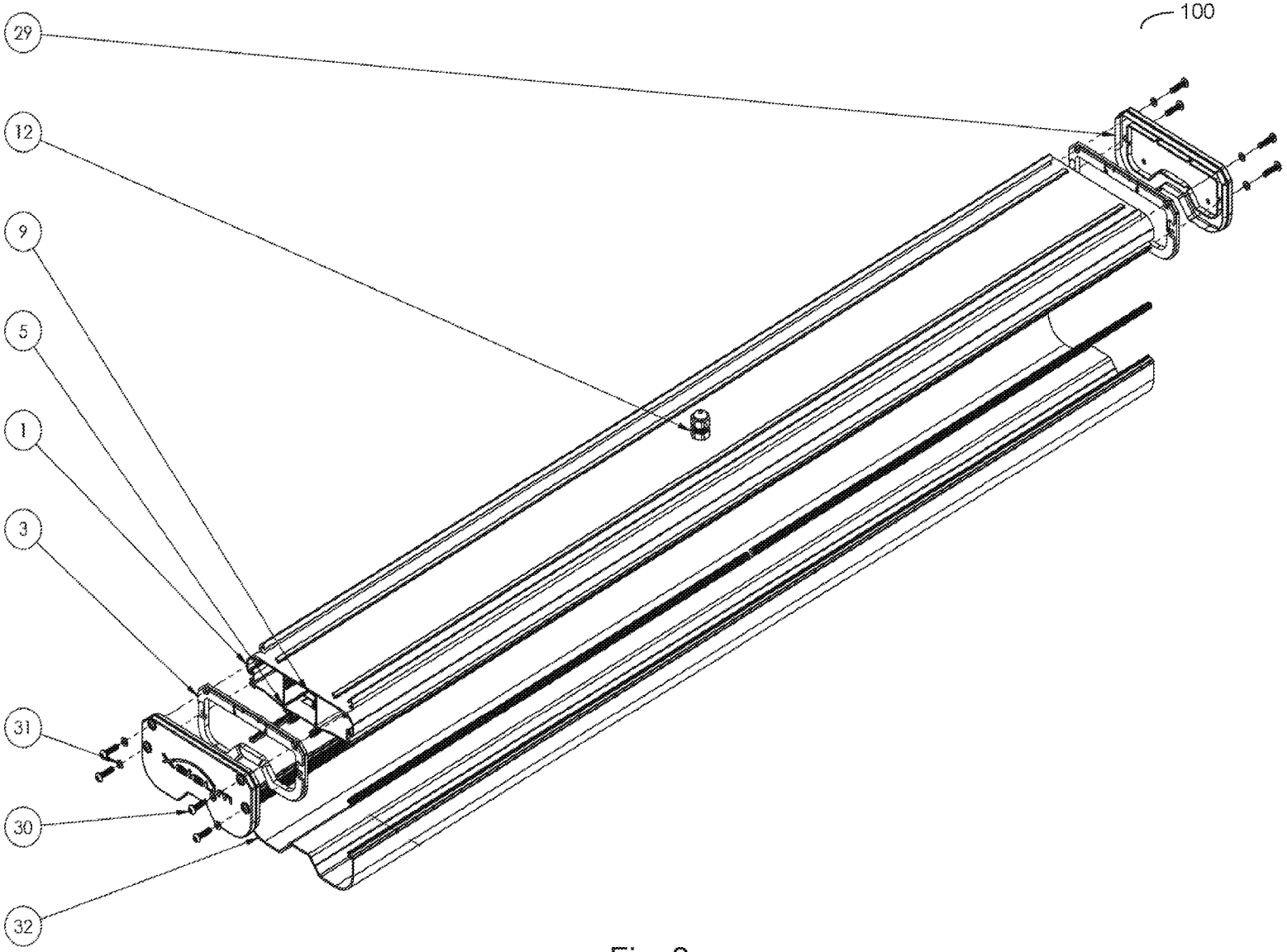
FIG. 2 schematically illustrates an isometric view of the example lighting enclosure.

FIG. 1 schematically illustrates a transverse cross-section (i.e., a cross-section in a plane which is orthogonal to the longitudinal axis) of an example lighting enclosure, the isometric view of which is shown in FIG. 2. As shown in FIG. 2, the example lighting enclosure 100 includes the elongated housing 1 which is attached to the light diffuser 32, as described in more detail herein below. The housing 1 and the light diffuser 32 may be produced by extrusion, molding, casting, or a combination of these and other methods. The housing 1 may be made of plastic, metal, and/or a combination of these and other material. The light diffuser 32 may be made of plastic having suitable light diffusing features.

The example lighting enclosure 100 further includes a pair of end caps 29 which are attached, by screws 30, to the assembly of the elongated housing 1 and the light diffuser 32. An end cap gasket 3 is inserted between each end cap 29 and the assembly of the elongated housing 1 and the light diffuser 32, thus sealing the surface edge of the end cap 29.

The elongated housing 1 further includes the mounting plane 9, on which the cable gland 12 may be mounted.

Referring again to FIG. 1, the example lighting enclosure 100 further includes light emitting devices 14 (which may be provided by LED panels) powered by the current driver 34, which may be protected by the surge protector 6. In certain implementations, the example lighting enclosure 100 may further include a radio frequency (RF) transceiver and a microcontroller implementing a network protocol stack and a driver for communicating to one or more nodes of a wireless lighting control network; the radio frequency transceiver may be electrically coupled, by one or more wires, to the antenna 7. Example lighting enclosure 100 may further comprise various other parts which are not described here and/or omitted from FIGS. 1-5 for clarity and conciseness.

Figure 3:
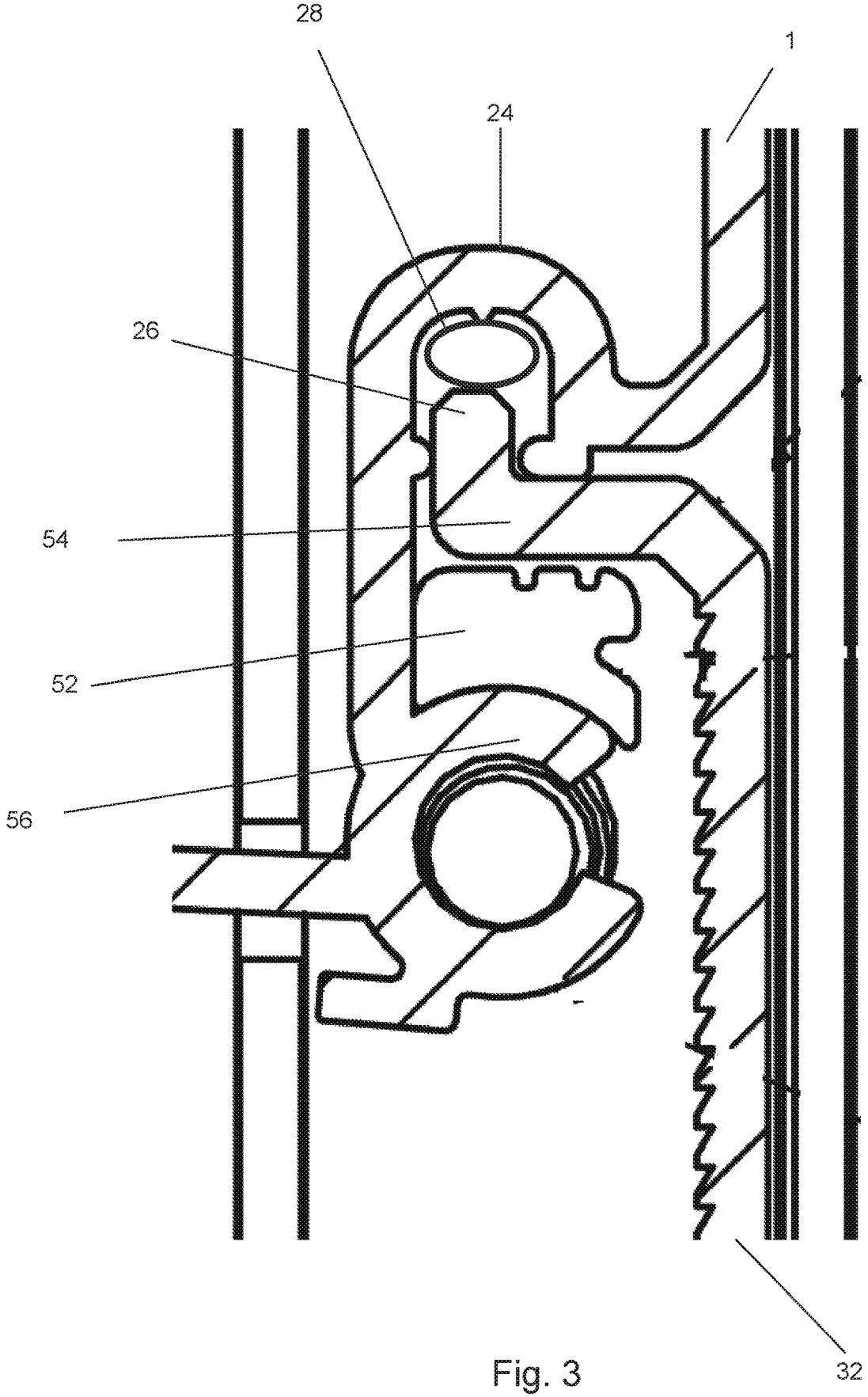
FIG. 3 represents an enlarged view of cross-section of a joint of the housing and the light diffuser of the example lighting enclosure, in accordance with one or more aspects of the present disclosure.
Figure 4:
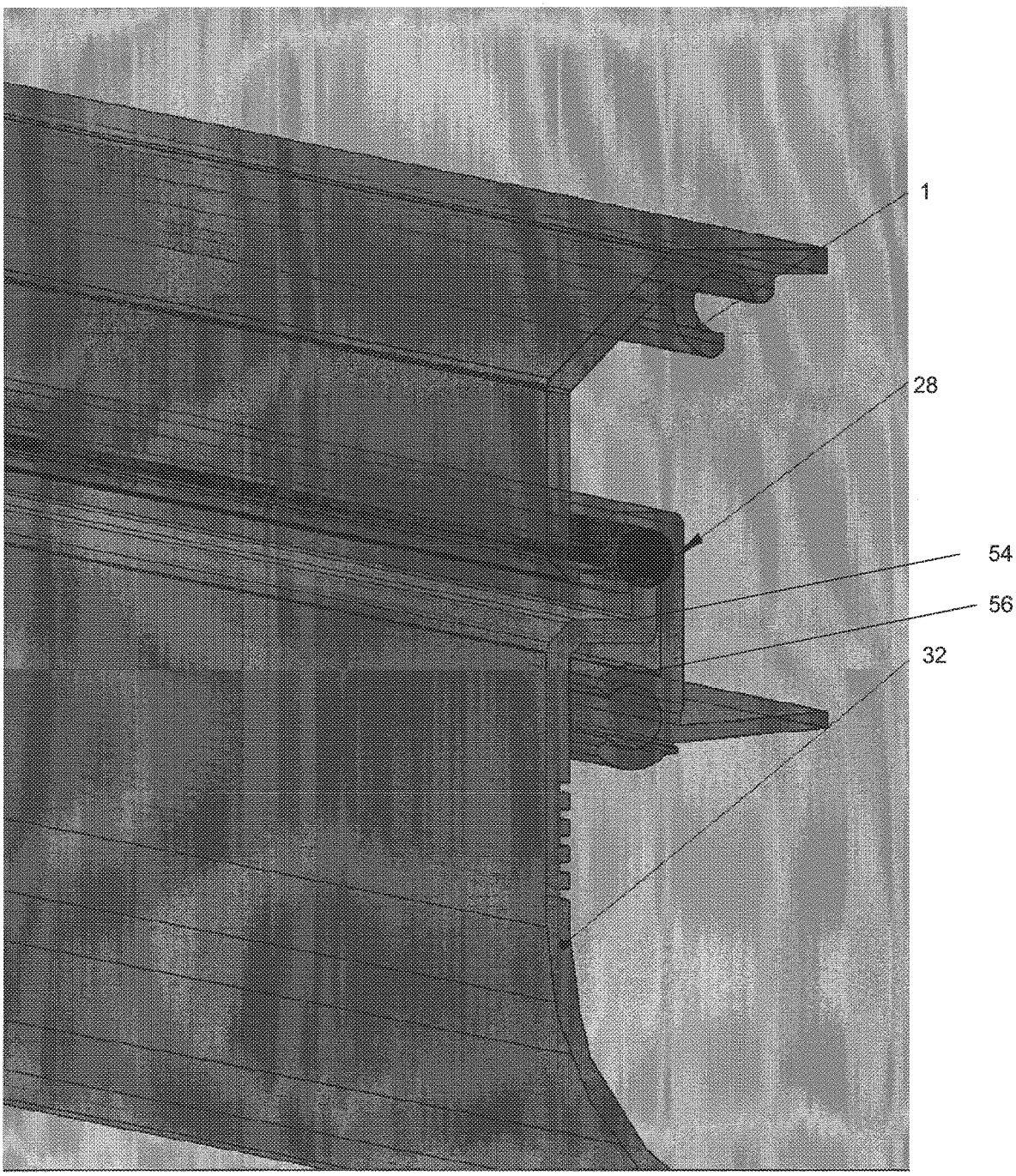
FIG. 4 represents an isometric view of a joint of the housing and the light diffuser of the example lighting enclosure, in accordance with one or more aspects of the present disclosure.
Figure 5:
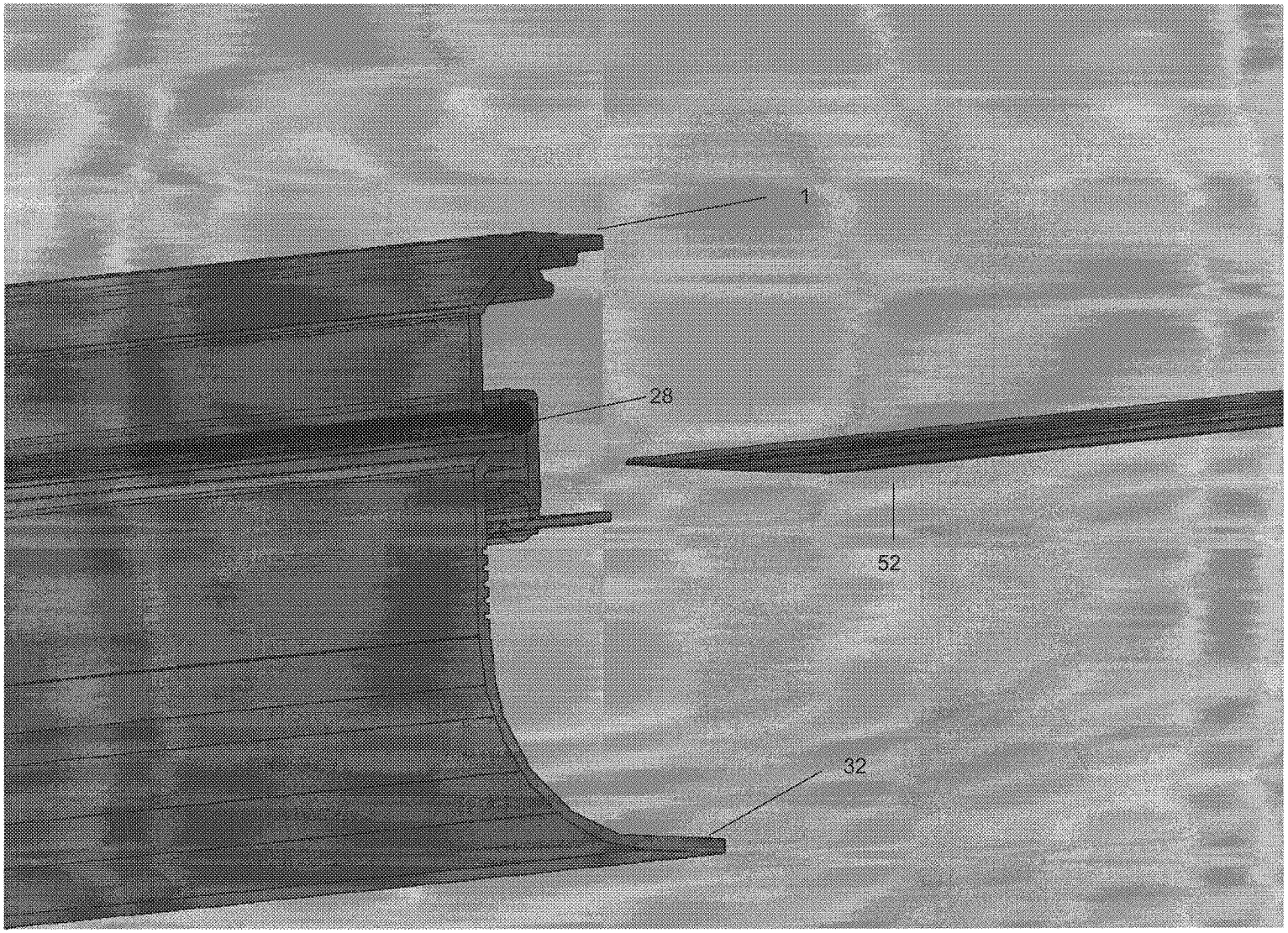
FIG. 5 represents an isometric view of a joint of the housing and the light diffuser of the example lighting enclosure before inserting the compression strip, in accordance with one or more aspects of the present disclosure.
Figure 6:
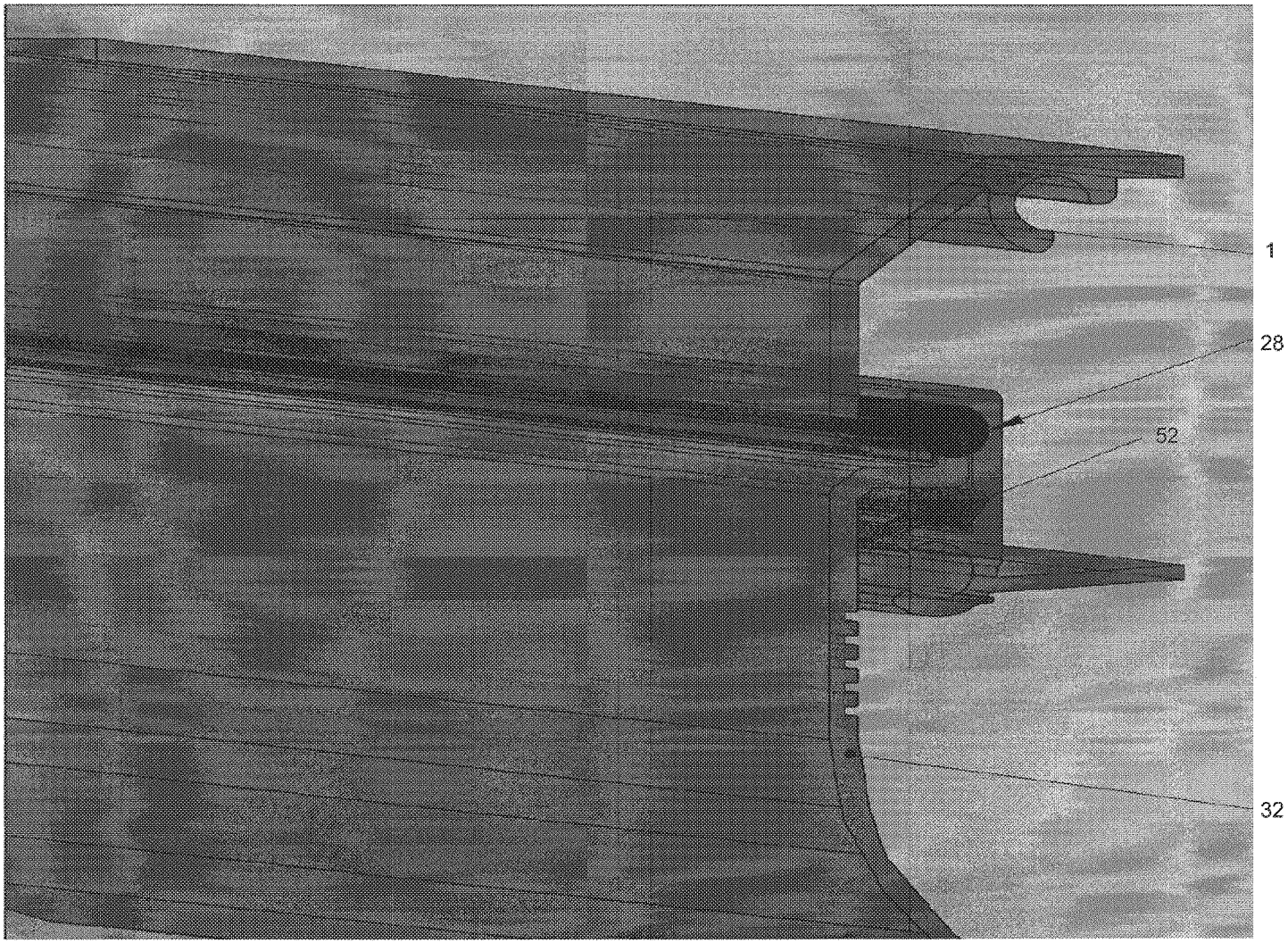
FIG. 6 represents an isometric view of a joint of the housing and the light diffuser of the example lighting enclosure after inserting the compression strip, in accordance with one or more aspects of the present disclosure.

As shown in FIG. 1, the housing 1 and the light diffuser 32 are joined together along their longitudinal edges 20L-20R. FIG. 3 represents an enlarged view of the cross-section of the right-hand side joint 20R of the housing 1 and the light diffuser 32, in accordance with one or more aspects of the present disclosure. FIGS. 4-6 illustrate an isometric view of the left-hand side 20L of the housing 1 and the light diffuser 32, in accordance with one or more aspects of the present disclosure. Since the housing 1 and the light diffuser 32 are symmetrical along the vertical axis 22, the left-hand side 20L and right-hand side 20R joints are symmetrical, and thus the below description equally applies to any or both joints 20L and 20R.

The edge of housing 1 includes the longitudinal groove element 24 which is a linear recessed element parallel to the longitudinal axis of the housing, the transverse cross-section of which represents a deep narrow channel. The groove element is designed to engage with an outwardly bent longitudinal edge element 26 of the diffuser 32, such that the edge element 26 is inserted into the groove element 24. The groove element The linear gasket 28 is inserted in the edge element 24, thus occupying the gap between the edge element 26 and the groove element 24. In order to seal the joint, the compression strip 52 is inserted between the base 54 of the edge element 26 and the longitudinal overhanging element 56 of the housing 1. FIG. 5 shows the compression strip 52 before insertion, and FIG. 6 shows the fully inserted compression strip 52.

As shown in FIGS. 3 and 6, the compression strip 52, when fully inserted between the base 54 of the edge element 26 and the overhanging element 56 of the housing 1, would push the 54 of the edge element 26 to further engage with the groove element 24, thus compressing the linear gasket 28 by reducing the gap between the groove element 24 and the edge element 26.

As shown in FIG. 3, the longitudinal overhanging element 56 is rigidly connected to the groove element 24 and extends in the direction which is substantially parallel to the base 54 of the edge element 26, thus creating the space between itself and the base 54 of the edge element 26, in which the compression strip 52 may be inserted. In the illustrative example of FIG. 3, the transverse cross-section of the overhanging element 56 is an open ring, thus providing for further rigidity of the overhanging element 56; other shapes may be utilized for implementing the overhanging element 56.

The linear gasket 28 may be made of a resilient material (e.g., plastic or rubber) which is elastically deformable to cause the linear gasket 28 to take a shape of the gap between the groove element 24 and the edge element 26. The transverse cross-section of the linear gasket 28 is a convex form, such as circle, ellipse, etc., which provides the requisite elastic deformation features of the linear gasket 28.

The compression strip 52 may be made of a rigid material (e.g., plastic or rubber) such that, once inserted between the base 54 of the edge element 26 and the longitudinal overhanging element 56, the compression strip 52 would push the base 54 of the edge element 26 to further engage with the groove element 24. In an illustrative example, the transverse cross-section of the compression strip 52 is a convex form, such as a trapezoid, which facilitates the insertion of the compression strip 52 in the gap between the base 54 of the edge element 26 and the overhanging element 56 while providing the requisite elastic deformation features of the compression strip 52.

Thus, in an illustrative example, a lighting enclosure implemented in accordance with one or more aspects of the present disclosure may include a first elongated part (housing) and a second elongated part (light diffuser) attached to the first elongated part. The second elongated part may include an outwardly bent longitudinal edge element engaged with a longitudinal groove element of the first elongated part. A linear gasket may be inserted into the gap between the longitudinal groove element and the outwardly bent longitudinal edge element. A compression strip may be inserted between the base of the outwardly bent longitudinal edge element and a longitudinal overhanging element of the first elongated part, such that the compression strip would push the base of the outwardly bent longitudinal edge element to further engage with the longitudinal groove element, thus compressing the linear gasket by reducing the gap between the longitudinal groove element and the outwardly bent longitudinal edge element.

In another illustrative example, a lighting enclosure implemented in accordance with one or more aspects of the present disclosure may include a housing and a light diffuser attachable to the housing. The light diffuser may include an outwardly bent longitudinal edge element insertable into the longitudinal groove element. A linear gasket may be insertable into a gap between the longitudinal groove element and the outwardly bent longitudinal edge element. A compression strip may be insertable between the base of the outwardly bent longitudinal edge element and a longitudinal overhanging element of the housing, such that the compression strip would push the base of the outwardly bent longitudinal edge element to further engage with the longitudinal groove element, thus compressing the linear gasket by reducing the gap between the longitudinal groove element and the outwardly bent longitudinal edge element.

Figure 7:
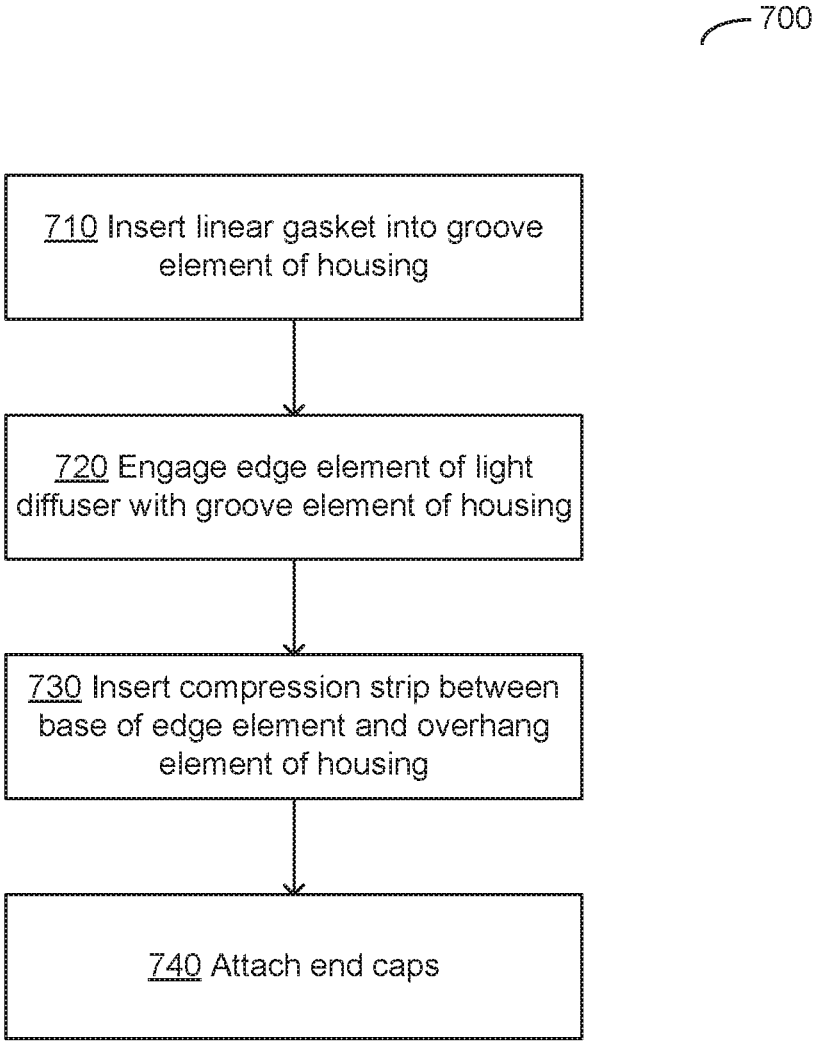
FIG. 7 schematically illustrates a flowchart of an example method of assembling a lighting enclosure, in accordance with one or more aspects of the present disclosure.

FIG. 7 schematically illustrates a flowchart of an example method of assembling a lighting enclosure, in accordance with one or more aspects of the present disclosure. Operations of method 700 may be performed in the order in which they are described or in any other order; at least some of the operations may be performed simultaneously, while other operations may be performed sequentially with respect to each other.

The operation 710 may involve inserting a linear gasket into a longitudinal groove element of the first elongated part (e.g., the housing) of the lighting fixture being assembled.

The operation 720 may involve engaging an outwardly bent longitudinal edge element of the second elongated part (e.g., the light diffuser) of the lighting fixture with the longitudinal groove element, as described in more detail herein above.

The operation 730 may involve inserting a compression strip between the base of the outwardly bent longitudinal edge element and the longitudinal overhanging element of the second elongated part, as described in more detail herein above.

The operations 710-730 may be performed for each linear joint of the first elongated part and the second elongated part.

The operation 740 may involve attaching the end caps to the respective ends of the assembly including the first elongated part and the second elongated part.

It is to be understood that the above description is intended to be illustrative, and not restrictive. Many other implementation examples will be apparent to those of skill in the art upon reading and understanding the above description. Although the present disclosure describes specific examples, it will be recognized that the systems and methods of the present disclosure are not limited to the examples described herein, but may be practiced with modifications within the scope of the appended claims. Accordingly, the specification and drawings are to be regarded in an illustrative sense rather than a restrictive sense. The scope of the present disclosure should, therefore, be determined with reference to the appended claims, along with the full scope of equivalents to which such claims are entitled.

What is claimed is:

1. A lighting enclosure, comprising:

a first elongated part comprising a longitudinal groove element;

a second elongated part attached to the first elongated part, wherein the second elongated part comprises an outwardly bent longitudinal edge element engaged with the longitudinal groove element;

a linear gasket disposed in a gap between the longitudinal groove element and the outwardly bent longitudinal edge element; and a compression strip disposed between a base of the outwardly bent longitudinal edge element and a longitudinal overhanging element of the first elongated part, wherein a cross-section of the longitudinal overhanging element is represented by an open ring;

wherein the compression strip is operable to push the base of the outwardly bent longitudinal edge element to further engage with the longitudinal groove element thus compressing the linear gasket by reducing the gap between the longitudinal groove element and the outwardly bent longitudinal edge element.

2. The lighting enclosure of claim 1, wherein the longitudinal overhanging element is rigidly connected to the longitudinal groove element.

3. The lighting enclosure of claim 1, wherein the longitudinal overhanging element extends in a direction which is substantially parallel to the base of the outwardly bent longitudinal edge element.

4. The lighting enclosure of claim 1, further comprising a first end cap and a second end cap, wherein the first end cap is attached to a first end of an assembly including the first elongated part and the second elongated part, and wherein the second end cap is attached to a second end of the assembly.

5. The lighting enclosure of claim 1, wherein the linear gasket is made of a resilient material which is elastically deformable to cause the linear gasket to take a shape of the gap between the longitudinal groove element and the outwardly bent longitudinal edge element.

6. The lighting enclosure of claim 1, wherein the linear compression strip is made of a rigid material to cause the linear compression strip to push the base of the outwardly bent longitudinal edge element to further engage with the longitudinal groove element.

7. The lighting enclosure of claim 1, wherein the linear gasket has a convex transverse cross-section.

8. The lighting enclosure of claim 1, wherein the first elongated part is produced by one of: extrusion, molding, or casting.

9. The lighting enclosure of claim 1, wherein the first elongated part is represented by a housing.

10. The lighting enclosure of claim 1, wherein the second elongated part is represented by a light diffuser.

11. The lighting enclosure of claim 1, wherein the longitudinal groove element is represented by a linear recessed element which is parallel to a longitudinal axis of the first elongated part.

12. The lighting enclosure of claim 1, wherein the longitudinal groove element has a transverse cross-section represented by a deep narrow channel.

13. A lighting enclosure, comprising:

a housing comprising a longitudinal groove element;

a light diffuser attachable to the housing, wherein the light diffuser comprises an outwardly bent longitudinal edge element engaged with the longitudinal groove element;

a linear gasket disposed in a gap between the longitudinal groove element and the outwardly bent longitudinal edge element; and a compression strip disposed between a base of the outwardly bent longitudinal edge element and a longitudinal overhanging element of the housing, wherein a cross-section of the longitudinal overhanging element is represented by an open ring.

14. The lighting enclosure of claim 13, wherein the compression strip is operable to push the base of the outwardly bent longitudinal edge element to be further inserted into the longitudinal groove element thus compressing the linear gasket by reducing the gap between the longitudinal groove element and the outwardly bent longitudinal edge element.

15. The lighting enclosure of claim 13, wherein the longitudinal overhanging element extends in a direction which is substantially parallel to the base of the outwardly bent longitudinal edge element.

16. A method of assembling a lighting fixture, the method comprising:

inserting a linear gasket into a longitudinal groove element of a housing of the lighting fixture;

engaging an outwardly bent longitudinal edge element of a light diffuser of the lighting fixture with the longitudinal groove element; and inserting a compression strip between a base of the outwardly bent longitudinal edge element and a longitudinal overhanging element of the housing, wherein a cross-section of the longitudinal overhanging element is represented by an open ring.

17. The method of claim 16, wherein the compression strip is operable to push the base of the outwardly bent longitudinal edge element to further engage with the longitudinal groove element thus compressing the linear gasket by reducing the gap between the longitudinal groove element and the outwardly bent longitudinal edge element.

18. The method of claim 16, further comprising:

attaching a first end cap to a first end of an assembly including the housing and the light diffuser.

19. The method of claim 16, wherein the longitudinal overhanging element extends in a direction which is substantially parallel to the base of the outwardly bent longitudinal edge element.

20. The method of claim 16, wherein the longitudinal overhanging element is rigidly connected to the groove element.

* * * * *